US009711078B2

(12) United States Patent
Yagiura

(10) Patent No.: US 9,711,078 B2
(45) Date of Patent: Jul. 18, 2017

(54) DISPLAY DEVICE

(71) Applicant: Japan Display Inc., Tokyo (JP)

(72) Inventor: Ken Yagiura, Tottori (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/831,053

(22) Filed: Aug. 20, 2015

(65) Prior Publication Data

US 2015/0356908 A1 Dec. 10, 2015

Related U.S. Application Data

(60) Continuation of application No. 13/966,947, filed on Aug. 14, 2013, now Pat. No. 9,153,204, which is a (Continued)

(30) Foreign Application Priority Data

Dec. 10, 2009 (JP) ..... P2009-280152
Dec. 14, 2009 (JP) ..... P2009-282595

(51) Int. Cl.
*G09G 3/00* (2006.01)
*G09G 3/36* (2006.01)
(Continued)

(52) U.S. Cl.
CPC ..... *G09G 3/2074* (2013.01); *G09G 3/003* (2013.01); *G09G 3/3611* (2013.01);
(Continued)

(58) Field of Classification Search
CPC ..... G09G 3/003; G09G 3/3611; G09G 2310/0218; G09G 2320/0209;
(Continued)

(56) References Cited

U.S. PATENT DOCUMENTS 5,883,789 A 3/1999 O'Coin
6,384,839 B1 5/2002 Pauk
(Continued)

FOREIGN PATENT DOCUMENTS

JP 07-103784 4/1995
JP 2004-279482 10/2004
(Continued)

*Primary Examiner* — Charles Hicks
(74) *Attorney, Agent, or Firm* — K&L Gates LLP

(57) ABSTRACT

Disclosed herein is a display device, including: a display panel having a display area having a plurality of pixels each composed of one or more sub-pixels, a first image and a second image being alternately displayed adjacent to each other in the sub-pixels, the first image and the second image being displayed in visual directions different from each other so as to be adapted to be discriminated from each other; and a crosstalk correcting portion having a crosstalk correcting table, configured to carry out crosstalk correction for images different from one another by using the crosstalk correcting table; wherein the display area is divided into a plurality of areas, and gamma correction which differs so as to correspond to the plurality of areas obtained through the division, respectively, is carried out for an image as an object of the crosstalk correction.

14 Claims, 12 Drawing Sheets

Related U.S. Application Data division of application No. 12/959,628, filed on Dec. 3, 2010, now abandoned.

(51) Int. Cl.

| | |
|---|---|
| ***G09G 3/20*** | (2006.01) |
| ***G09G 3/06*** | (2006.01) |
| ***G09G 5/02*** | (2006.01) |
| ***G09G 5/06*** | (2006.01) |

(52) U.S. Cl.

CPC ..... *G09G 3/3648* (2013.01); *G09G 3/3696* (2013.01); *G09G 5/02* (2013.01); *G09G 5/06* (2013.01); *G09G 2310/0218* (2013.01); *G09G 2320/0209* (2013.01); *G09G 2320/0673* (2013.01)

(58) Field of Classification Search

CPC ..... G09G 2320/0673; G09G 3/2074; G09G 5/06; G09G 3/3648; G09G 3/3696; G09G 5/02

See application file for complete search history.

(56) References Cited

U.S. PATENT DOCUMENTS

| | | | | |
|---|---|---|---|---|
| 2002/0063807 | A1* | 5/2002 | Margulis | G06T 1/20 348/745 |
| 2004/0179029 | A1 | 9/2004 | Ogawa et al. | |
| 2005/0258341 | A1 | 11/2005 | Nishikawa et al. | |
| 2008/0231547 | A1* | 9/2008 | Yagiura | G09G 3/003 345/4 |
| 2008/0272999 | A1 | 11/2008 | Kurokawa et al. | |
| 2009/0002268 | A1 | 1/2009 | Ueta et al. | |
| 2009/0079680 | A1 | 3/2009 | Yagiura | |
| 2011/0141130 | A1* | 6/2011 | Yagiura | G09G 3/003 345/589 |

FOREIGN PATENT DOCUMENTS

| | | |
|---|---|---|
| JP | 2005-091561 | 4/2005 |
| JP | 2006-184859 | 7/2006 |
| JP | 2006-276591 | 10/2006 |
| JP | 2009-080237 | 4/2007 |
| JP | 2008-262157 | 10/2008 |

* cited by examiner

FIG.9A

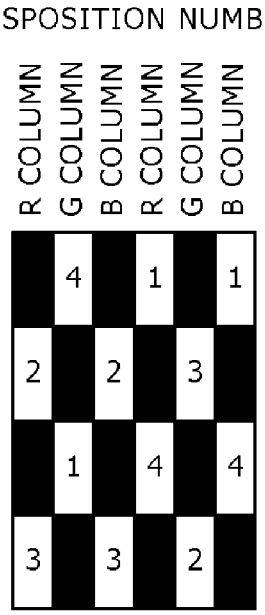

FIG.9B

| CORRECTION VALUE AFTER DECIMAL POINT | DATA IN LU | CORRECTION AMOUNT OF 1-ST FRAME | | | | CORRECTION AMOUNT OF 2-ND FRAME | | | | CORRECTION AMOUNT OF 3-RD FRAME | | | | CORRECTION AMOUNT OF 4-TH FRAME | | | |
|---|---|---|---|---|---|---|---|---|---|---|---|---|---|---|---|---|---|
| | | DISPOSITION 1 | DISPOSITION 2 | DISPOSITION 3 | DISPOSITION 4 | DISPOSITION 1 | DISPOSITION 2 | DISPOSITION 3 | DISPOSITION 4 | DISPOSITION 1 | DISPOSITION 2 | DISPOSITION 3 | DISPOSITION 4 | DISPOSITION 1 | DISPOSITION 2 | DISPOSITION 3 | DISPOSITION 4 |
| | | 0 | 0 | 0 | 0 | 0 | 0 | 0 | 0 | 0 | 0 | 0 | 0 | 0 | 0 | 0 | 0 |
| | | 1 | 0 | 0 | 0 | 0 | 1 | 0 | 0 | 0 | 0 | 1 | 0 | 0 | 0 | 0 | 1 |
| | | 1 | 0 | 1 | 0 | 0 | 1 | 0 | 1 | 1 | 0 | 1 | 0 | 0 | 1 | 0 | 1 |
| | | 0 | 1 | 1 | 1 | 1 | 0 | 1 | 1 | 1 | 1 | 0 | 1 | 1 | 1 | 1 | 0 |

DISPLAY DEVICE

CROSS REFERENCES TO RELATED APPLICATIONS

The present application is a Continuation application of U.S. patent application Ser. No. 13/966,947, filed Aug. 14, 2013, which application is a Divisional application of U.S. patent application Ser. No. 12/959,628 filed Dec. 3, 2010, which claims priority to Japanese Priority Patent Applications JP 2009-280152 and 2009-282595 filed in the Japan Patent Office on Dec. 10, 2009 and Dec. 14, 2009, respectively, the entire contents of which are hereby incorporated by reference.

BACKGROUND

The present application relates to a display device having a display panel for displaying a first and second image sub-pixels for which are alternately adjacent to each other in different visual directions, respectively, so as to allow the first image and the second image to be discriminated from each other by light blocking of slits.

A liquid crystal display panel is used for display in many electronic apparatuses because the liquid crystal display panel has the features such as light-weight, thinness and low power consumption as compared with a Cathode Ray Tube (CRT). On the other hand, an electronic apparatus for displaying a plurality of different images in respective visual directions different from one another so as to allow a plurality of different images to be discriminated from one another has been developed along with the diversification of the recent electronic apparatuses. This technique is such that sub-pixels each a minimum unit in different images are displayed on a panel alternately so as to be adjacent to one another, thereby being separated from each other in the different visual directions so as to allow the different images to be discriminated from one another. A first example of this separating technique is based on a lenticular lens and, for example, is described in Japanese Patent Laid-Open No. Hei 7-103784, hereinafter referred to as Patent Document 1 (refer to FIG. 6). A second example of this technique is based on stripe-shaped protrusion patterns provided on both sides of a position facing a signal line, respectively, and, for example, is described in Japanese Patent Laid-Open No. 2006-276591, hereinafter referred to as Patent Document 2 (refer to FIG. 1). A third example of this technique is based on a light blocking pattern of a light crystal shutter, and, for example, is described in Japanese Patent Laid-Open No. 2006-184859, hereinafter referred to as Patent Document 3 (refer to FIGS. 3 and 14). Also, a fourth example of this technique is based on a light blocking pattern of a light blocking member, and, for example, is described in Japanese Patent Laid-Open Nos. 2005-091561, hereinafter referred to as Patent Document 4 (refer to FIG. 3) and 2008-262157, hereinafter referred to as Patent Document 5 (refer to FIG. 18). With regard to a shape of this light blocking pattern, there are a stripe-like pattern which is shown in FIG. 3 of Patent Document 3, and a checkered pattern which is shown in FIG. 10 of Patent Document 5.

A first example of application of this technique is a stereoscopic image display device in which right-hand and left-hand side eyes are set so as to correspond to the different visual directions, respectively. This content, for example, is described in a paragraph number of 0008 of Patent Document 2. A second example of application of this technique is a display device for teaching materials in which a teacher and a student facing each other through a display panel are set so as to correspond to the different visual directions, respectively. This content, for example, is shown in FIG. 4 of Patent Document 4. A third example of application of this technique is a display device in which two directions corresponding to a driver's seat and a passenger seat, respectively, are set as the different visual directions, respectively. This current, for example, is described in Patent Documents 1, 2, 3 and 5. Also, a fourth example of application of this technique is a display device in which three directions corresponding to a driver's seat, a passenger seat and a rear seat, respectively, are set as the different visual directions, respectively. This content, for example, is shown in FIG. 14 of Patent Document 3. In particular, for safe driving, for the purpose of prohibiting an image received by a television set or an image reproduced by a DVD player from being displayed in the driver's seat direction during the driving, many display devices in each of which the two directions corresponding to the driver's seat and the passenger seat, respectively, are set as the different directions, respectively, are offered commercially.

On the other hand, with the liquid crystal display panel, even in the case where even when a voltage corresponding to a predetermined gradation is applied to a sub-pixel, the gradation of a sub-pixel adjacent to the sub-pixel is different from that of that sub-pixel, different luminances are obtained in the sub-pixels adjacent to each other, respectively, due to generation of electrical crosstalk. With regard to the cause of the generation of the electrical crosstalk, it is thought that a spike generated along with the switching of a voltage of a scanning line fluctuates an effective value of a voltage applied to the pixel. In particular, in the above electronic apparatus for displaying a plurality of different images in the different visual directions, respectively, so as to allow a plurality of different images to be discriminated from one another, the different images are inputted to the adjacent sub-pixels, respectively, a lot of electrical crosstalk is generated.

For this reason, in the liquid crystal device using the liquid crystal display panel, the voltages for each of which the electrical crosstalk is corrected are applied to the liquid crystal display panel. With regard to the correcting method, as shown in FIG. 2 of Japanese Patent Laid-Open No. 2009-080237, hereinafter referred to as Patent Document 6, a designer previously obtains correction data on all combinations of the gradations of the sub-pixels to be corrected, and the gradations of the sub-pixels adjacent thereto, respectively, based on experiments. Thus, the designer creates an electrical correction table (hereinafter referred to as "a Lookup Table (LUT)") and stores the resulting LUT in an EEPROM or the like of the liquid crystal display device. The liquid crystal display device reads out correction data on the gradation of the sub-pixel to be corrected, and the gradation of the sub-pixel adjacent thereto from the electrical LUT, and adds the correction data thus read out to the gradation of the sub-pixel to be corrected, thereby outputting the resulting data to the liquid crystal display panel.

In addition, as described in Patent Documents 1 to 6, optical crosstalk due to a slit of the light blocking pattern is also generated in the electronic apparatus having the light blocking pattern. The optical crosstalk is caused by light leakage which is generated by diffraction of lights from the sub-pixels having the same color in the adjacent pixels through the slits of the light blocking pattern. With regard to the correcting method, as shown in FIG. 3 of Patent Document 6, the designer previously obtains the correction data on all the combinations of the gradations of the sub-pixels to be corrected, and the gradations of the sub-pixels having the same color and being adjacent thereto, respectively, based on the experiments. Thus, the designer creates an optical LUT, and stores the resulting optical LUT in the EEPROM or the like of the liquid crystal display device. The liquid crystal display device reads out the correction data on the gradations of the sub-pixels to be corrected, and the gradations of the sub-pixels having the same color and being adjacent thereto, respectively, and adds the correction data to the data on the gradations of the sub-pixels to be corrected, thereby outputting the resulting data to the liquid crystal display panel.

SUMMARY

As described above, there are carried out the crosstalk correction based on the adjacent sub-pixels, and the crosstalk correction based on the sub-pixels, having the same color, in the adjacent pixels. Heretofore, both the correction methods have been similarly carried out for any of positions (such as a center and edges) on the display area. However, strictly, the crosstalk due to the adjacent sub-pixels, and the crosstalk due to the sub-pixels, having the same color, in the adjacent pixels are different in amount of crosstalk from each other depending on the positions on the display area. For this reason, there is encountered such a problem that with the existing crosstalk correction, it may be impossible to carry out the proper correction.

FIG. 11A is a diagram showing a visual angle of a navigation system for displaying thereon different images in a driver's seat direction and in a passenger seat direction, respectively. FIG. 11B is a graph showing a change of a visual angle depending on the center shift positions on a display area. In FIG. 11A, reference symbol E1 designates a point of view of a driver in a car with the steering wheel on the right side. For example, the point E1 of view corresponds to 30° in a counterclockwise fashion with respect to a perpendicular line to a center S of a display area, and a distance from the center S of the display area to the point E1 of view is 700 mm. In addition, reference symbol E2 designates a point of view of a passenger sitting on a passenger seat in a car with the steering wheel on the right side. The point E2 of view corresponds to 30° in a clockwise fashion with respect to the perpendicular to the center S of the display area, and a distance from the center S of the display area to the point E2 of view is 700 mm. Reference symbol P1 designates an edge of a 7-inch type display area. The edge P1 of the 7-inch type display area is located at a distance of 60 mm away from the center S of the display area. The visual angle from the point E2 of view to the edge P1 is 34.07° which is 4.07° larger than that from the point E2 of view to the center S of the display area.

Reference symbol P2 designates an edge of a horizontally long display area which has been recently used. The edge P2 is located at a distance of 140 mm away from the center S of the display area. The horizontally long display area is used to display a cluster for additional display of a mater or the like in an image by a navigation system, or to display two navigation images for additional display or the like of a detailed drawing and an enlarged drawing. The visual angle from the point E2 of view to the edge P2 is 38.95° which is 8.95° larger than that of 30° from the point E2 of view to the center S of the display area. Reference symbol E designates an arbitrary point of view with which the point-of-view distance becomes 700 mm from the center S of the display area. Reference symbol $\alpha$ designates a visual angle from the arbitrary point E of view to the center S of the display area. Also, reference symbol $\beta$ designates a visual angle from the arbitrary point E of view to a position P. When a distance from the center S of the display area to the position P is L mm, $\beta=\arctan((700 \sin \alpha+L)/700 \cos \alpha)$ is obtained. FIG. 11B is a graph showing a relationship between the angle $\alpha$ and the angle $\beta$ when L=60 mm and L=140 mm.

Heretofore, the crosstalk correction has also been carried out for each of the edges P1 and P2 of the display area by using the same method as that for the center S with either the point E1 of view of the driver's seat or the point E2 of view of the passenger seat as the reference. As shown in FIGS. 11A and 11B, as a position is further shifted from the center S, the visual angle of the position becomes larger than the visual angle of 30° of the center S. Since the visual angle differs in such a manner, even in any of the lenticular lens system, the light blocking pattern system and the like, not only the crosstalk due to the adjacent sub-pixels, but also the crosstalk due to the sub-pixels, having the same color, in the adjacent pixels differ in amount of crosstalk thereof depending on the positions on the display area. For this reason, there is caused such a problem that it may be impossible to carry out the sufficient crosstalk correction for the edge of the display area. In particular, this problem is regarded as important in the display device for the vehicle having the long display area in which the edge of the display area is designated by reference symbol P2.

The present application has been made in order to solve the problems described above, and it is therefore desirable to provide a display device which is capable of carrying out crosstalk correction corresponding to a position on a display area.

In order to attain the desire described above, according to an embodiment, there is provided a display device including: a display panel having a display area having a plurality of pixels each composed of one or more sub-pixels, a first image and a second image being alternately displayed adjacent to each other in the sub-pixels, the first image and the second image being displayed in visual directions different from each other so as to be adapted to be discriminated from each other; and a crosstalk correcting portion having a crosstalk correcting table, configured to carry out crosstalk correction for images different from one another by using the crosstalk correcting table; in which the display area is divided into a plurality of areas, and gamma correction which differs so as to correspond to the plurality of areas obtained through the division, respectively, is carried out for an image as an object of the crosstalk correction.

According to the display device of the embodiment, the gamma correction which differs depending on the positions on the display area is carried out for the image as an object of the crosstalk correction, whereby the difference in crosstalk depending on the positions on the display area is relaxed, thereby making it possible to carry out the data correction from the same LUT.

According to a further embodiment, there is provided a display device including: a display panel having a display area having a plurality of pixels each composed of one or more sub-pixels, a first image and a second image being alternately displayed adjacent to each other in the sub-pixels, the first image and the second image being displayed in visual directions different from each other so as to be adapted to be discriminated from each other; and a crosstalk correcting portion having a crosstalk correcting table, configured to carry out crosstalk correction for images different from one another by using the crosstalk correcting table; in which the display area is divided into a plurality of areas, and the crosstalk correcting table is composed of a plurality of crosstalk correcting tables corresponding to the plurality of areas obtained through the division, respectively.

Since the visual angle from the point of view differs depending on the positions on the display area, there is encountered such a problem that not only the crosstalk due to the adjacent sub-pixels, but also the crosstalk due to the sub-pixels, having the same color, in the adjacent pixels differ in amount of crosstalk thereof depending on the positions on the display area. According to the display device of the further embodiment, the crosstalk correcting tables which are different from one another depending on the positions on the display area are used, whereby it is possible to relax the difference in crosstalk depending on the positions on the display area.

In addition, in any of the display devices of the embodiment and the further embodiment, preferably, pixels of the display area are disposed in a matrix, and at least one of the division areas is non-rectangular.

In this case, when at least one of the division areas is non-rectangular in such a manner, for example, a shape of the at least one of the division areas is not a straight line in the longitudinal direction (in a direction of extension of each of signal lines), but is zigzag, each of boundary lines of the division areas comes to have difficulty seeing.

In addition, in any of the display devices of the embodiment and the further embodiment, preferably, the crosstalk correcting portion carries out the crosstalk correction of K (K: an integral number) gradations for N1 (N1: a positive integral number of smaller than N) in N (N: a positive integral number of equal to or larger than 2) frames, and carries out the crosstalk correction of the (K+1) gradations for the (N−N1) frames.

In this case, the crosstalk correction in which a minimum unit is seemingly smaller than one gradation is carried out with the frame rate control, whereby the gradation change in each of the boundary lines of the division areas can be made finer, and thus each of the boundary lines among the division areas comes to have difficulty seeing.

In addition, in any of the display devices of the embodiment and the further embodiment, preferably, the display panel includes slits of a light blocking layer with which the first image and the second image are made to be adapted to be discriminated from each other in different visual directions, respectively.

Many navigation systems in each of which with the slits of the light blocking layer, the different images can be discriminated in the driver's seat direction and in the passenger seat direction, respectively, are offered commercially. In the case described above, the present application can be applied to such a navigation system.

In addition, in any of the display devices of the embodiment and the further embodiment, preferably, the crosstalk correcting table contains therein correction data corresponding to gradations of sub-pixels each as an object of the correction, and gradations of sub-pixels adjacent thereto.

In this case, the crosstalk can be reduced by coping with the problem that the crosstalk, due to the adjacent sub-pixels, such as the electrical crosstalk differs depending on the positions on the display area.

In addition, in any of the display devices of the embodiment and the further embodiment, preferably, the one pixel is composed of sub-pixels having colors different from one another, and the crosstalk correcting table contains therein data corresponding to gradations of the sub-pixels each as an object of the correction, and gradations of the sub-pixels, having the same color, in the pixels adjacent thereto.

In this case, the crosstalk can be reduced by coping with the problem that the crosstalk, due to the sub-pixels having the same color in the adjacent pixels, such as the optical crosstalk due to the light diffraction in the slits of the light blocking pattern differs depending on the positions on the display area.

Additional features and advantages are described herein, and will be apparent from the following Detailed Description and the figures.

BRIEF DESCRIPTION OF THE FIGURES

FIGS. 9A and 9B are respectively a diagram showing an example of disposition of sub-pixels based on an FRC with four frames as one cycle and a table showing correction values for the sub-pixels of the FRC shown in FIG. 9A;

DETAILED DESCRIPTION

First Embodiment

Figure 1:
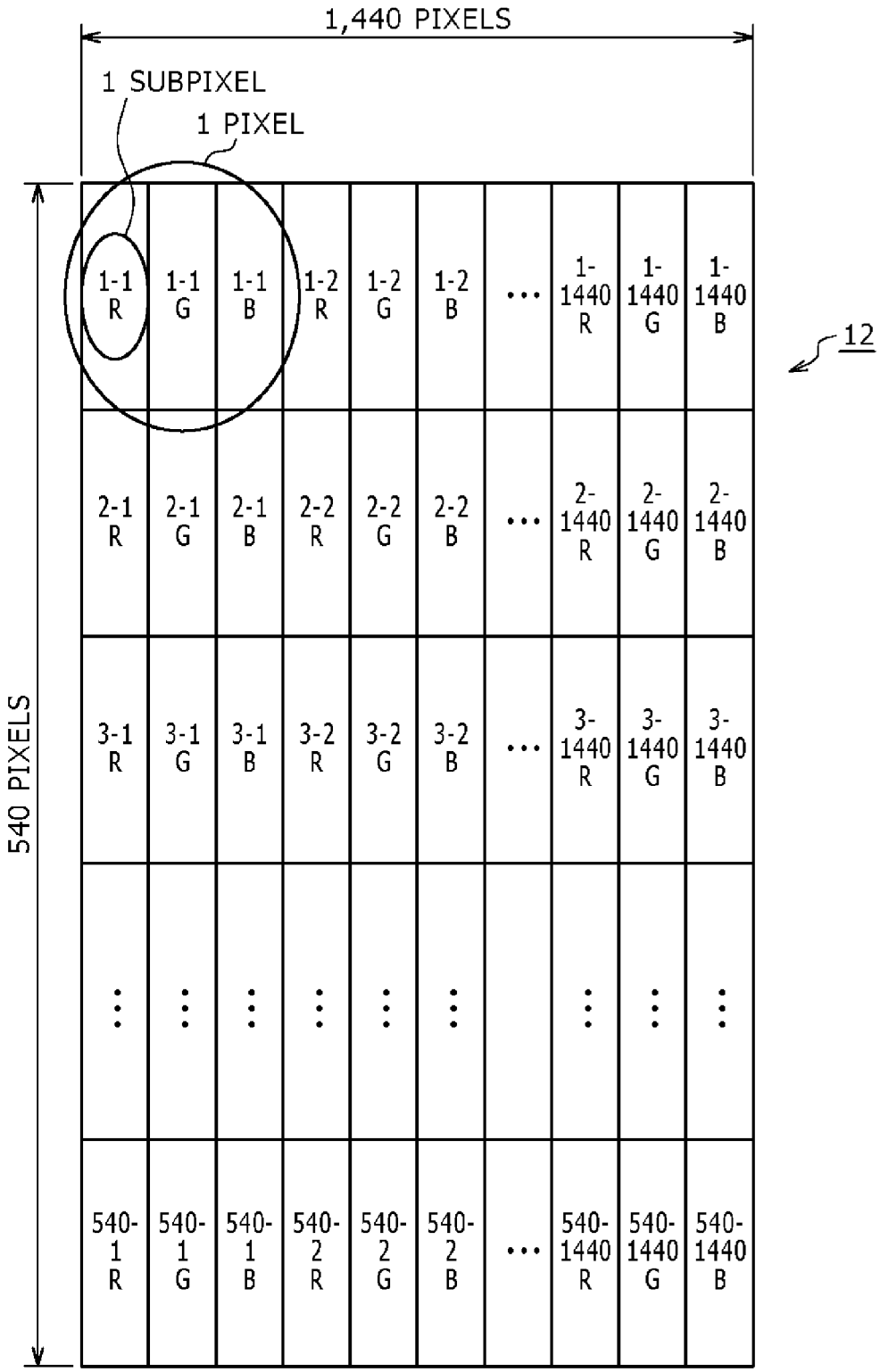
FIG. 1 is a diagram showing disposition of pixels in a liquid crystal display panel.

Although the preferred embodiments of the present application will be described in detail hereinafter with reference to the accompanying drawings, the preferred embodiments which will be shown below are not intended to limit the present application to the description. Thus, the present application can be equally applied to various kinds of changes which are made without departing from the technical idea shown in the appended claims. It is noted that in the drawings used for the descriptions in this specification, for the purpose of making layers and members have such sizes that they can be recognized on the drawings, the scale size is shown so as to be made to differ every layer and member, and thus is not necessarily shown in proportion to the actual size.

Figure 2:
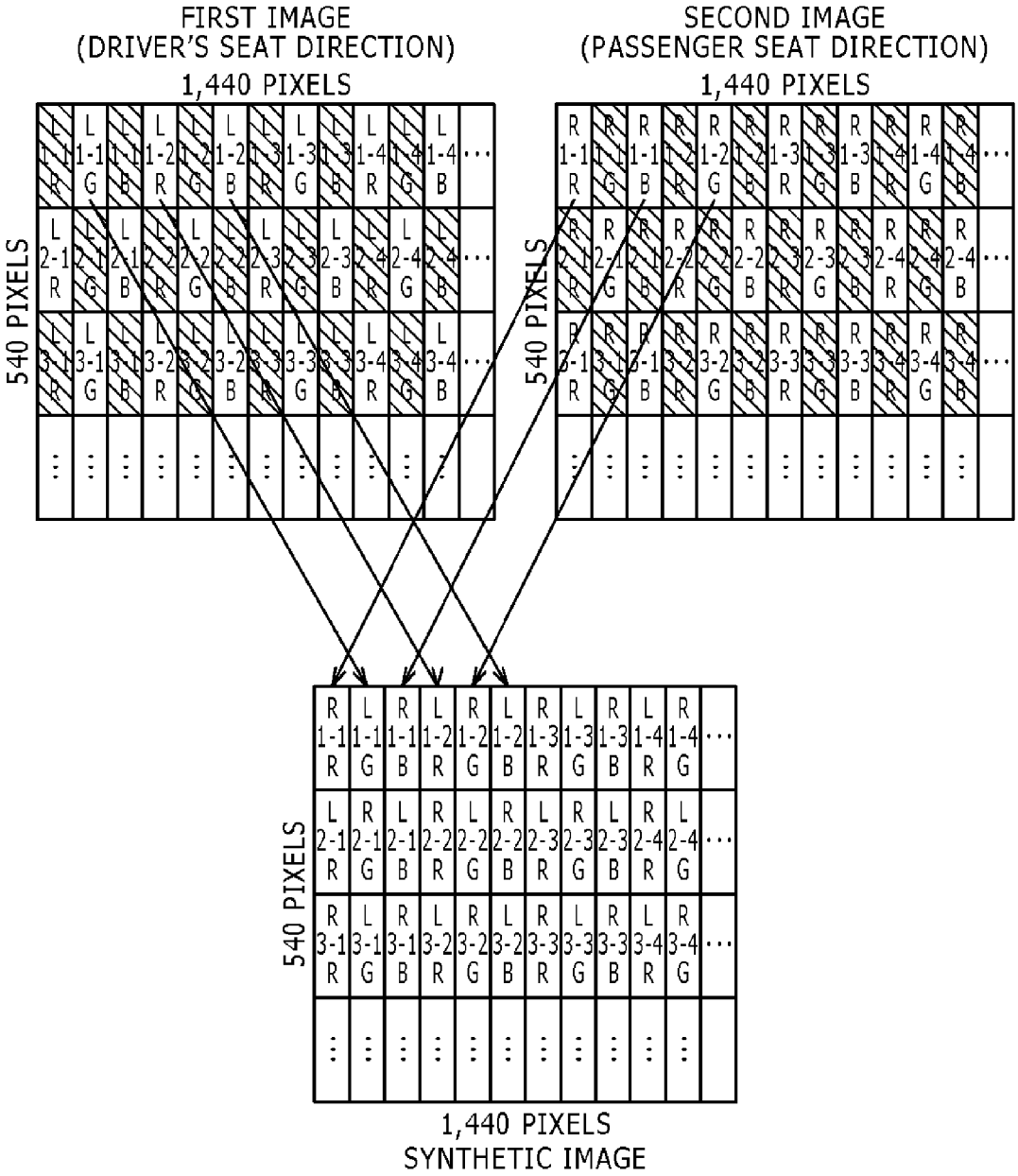
FIG. 2 is a diagram showing synthesis of two pictures.

A display device 10 according to a first embodiment is a display device for displaying a navigation image and a DVD-reproduced image in a driver's seat direction and in a passenger seat direction so as to allow the navigation image and the DVD-reproduced image to be discriminated from each other. Firstly, a structure of a display area 12 of a liquid crystal display panel 11 of the display device 10 will be described below. FIG. 1 is a diagram showing pixels in the display area 12. The display area 12 is composes of 1,440 pixels in an extension direction (in a transverse direction) of each of scanning lines (not shown), and 540 pixels in an extension direction (in a longitudinal direction) of each of signal lines (not shown). One pixel is composed of three sub-pixels of R(red), G(green) and B(blue) which are transversely disposed, and has approximately a square shape. Also, a color of one pixel is a mixed color of R, G and B of the sub-pixels. As shown in FIG. 2, an image displayed on the display area 12 is a synthetic image obtained by sorting out a first image displayed in the driver's seat direction in a car with the steering wheel on the right side, and a second image displayed in the passenger seat direction in the car with the steering wheel on the right side in units of sub-pixels in a checkered pattern (a black and white pattern in a chess).

Figure 3A:
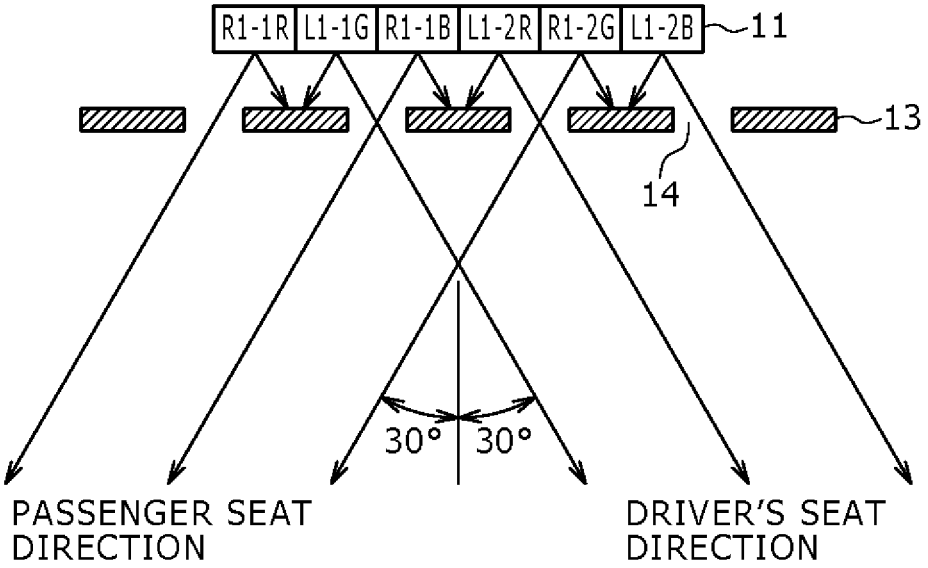
FIGS. 3A and 3B are respectively a cross sectional view showing the principle of image separation of two pictures, and a top plan view showing a light blocking pattern of a light blocking layer.
Figure 3B:
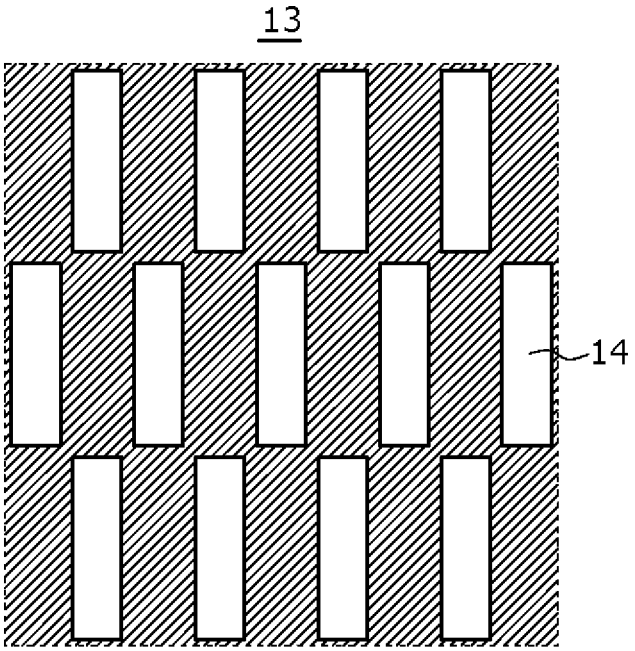

As shown in FIG. 3A, a light blocking barrier 13 is deposited on a display surface side in the liquid crystal display panel 11. Also, as shown in FIG. 3B, a light blocking pattern of a checkered pattern-like slits 14 is formed in the light blocking barrier 13. As shown in FIG. 3A, with regard to the sub-pixels of the first image, and the sub-pixels of the second image, the first image and the second image being alternately displayed adjacent to each other, in the driver's seat direction, the second image cannot be usually recognized, but only the first image is visually recognized. On the other hand, in the passenger seat direction, the first image cannot be visually recognized, but only the second image is visually recognized. For example, in the driver's seat direction, only the navigation picture is visually recognized, and in the passenger seat direction, only the DVD picture is visually recognized. The light blocking barrier 13 is formed in such a way that the luminance of the first image, and the luminance of the second image each become highest when the driver's seat direction and the passenger seat direction correspond to angles which are inclined in a counterclockwise fashion and in a clockwise fashion by 30° with respect to a perpendicular line to the display surface of the liquid crystal display panel 11, respectively.

Figure 4A:
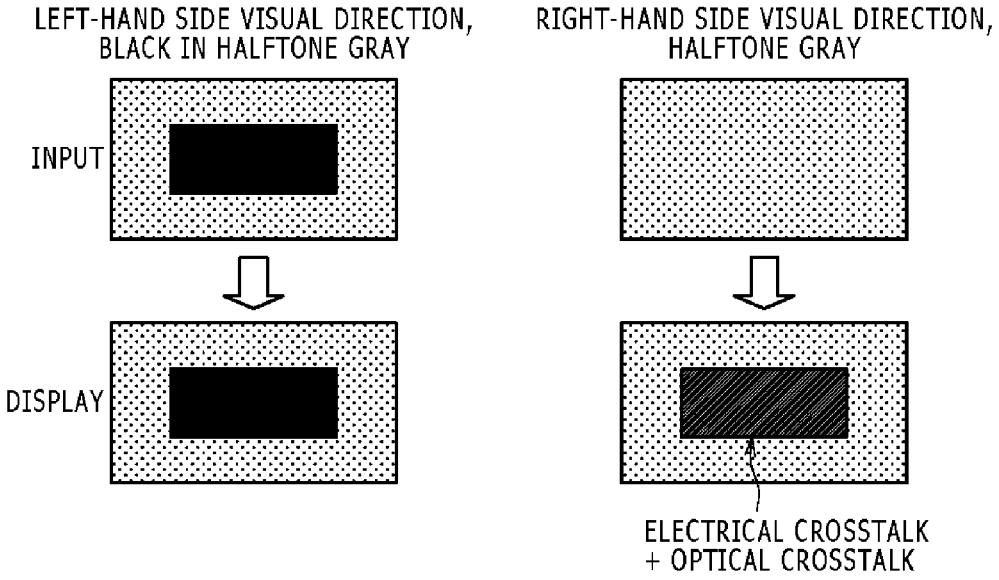
FIGS. 4A and 4B are respectively a top plan view showing generation of crosstalk, and a cross sectional view showing the generation of the crosstalk.
Figure 4B:
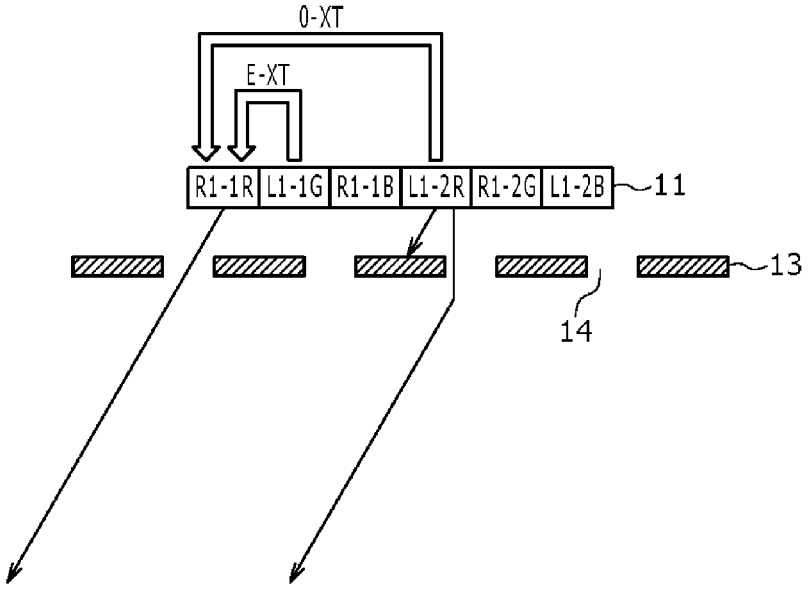

In the synthetic image in which different images are adjacent to one another as shown in FIG. 2, the voltages corresponding to different gradations are applied to the adjacent sub-pixels, respectively, in many cases as compared with the case of the images not synthesized. When the voltages corresponding to different gradations are applied to the adjacent sub-pixels, respectively, the electrical crosstalk becomes easy to generate. With regard to the cause of the electrical crosstalk, it is thought that the spike which is generated along with the switching of the voltage of the scanning line fluctuates an effective value of the voltage being applied to the pixel. For example, as shown in FIG. 4A, when in an image in left-hand side visual direction, a center of a halftone gray background is black, and an image in the right-hand side visual direction is halftone gray solid, the center of the image in the right-hand side visual direction is displayed so as to be colored with the slightly deep halftone gray because a voltage in the center of the image in the right-hand side visual direction is fluctuated by the electrical crosstalk (indicated by E-XT of FIG. 4B). The electrical crosstalk is generated when the gradations of the adjacent sub-pixels are different from each other in addition to the case of the synthetic image described above. In particular, since the sub-pixels of the different images are adjacent to each other in the synthetic image, the very large crosstalk is generated. For this reason, in the display device 10, the electrical crosstalk needs to be corrected. In addition, as shown in FIG. 4B, a light is diffracted in a slit 14 of the light blocking barrier 13, and thus lights leak from the sub-pixels, having the same color, in the adjacent pixels. This optical crosstalk (indicated by O-XT of FIG. 4B) also needs to be corrected.

Figure 5:
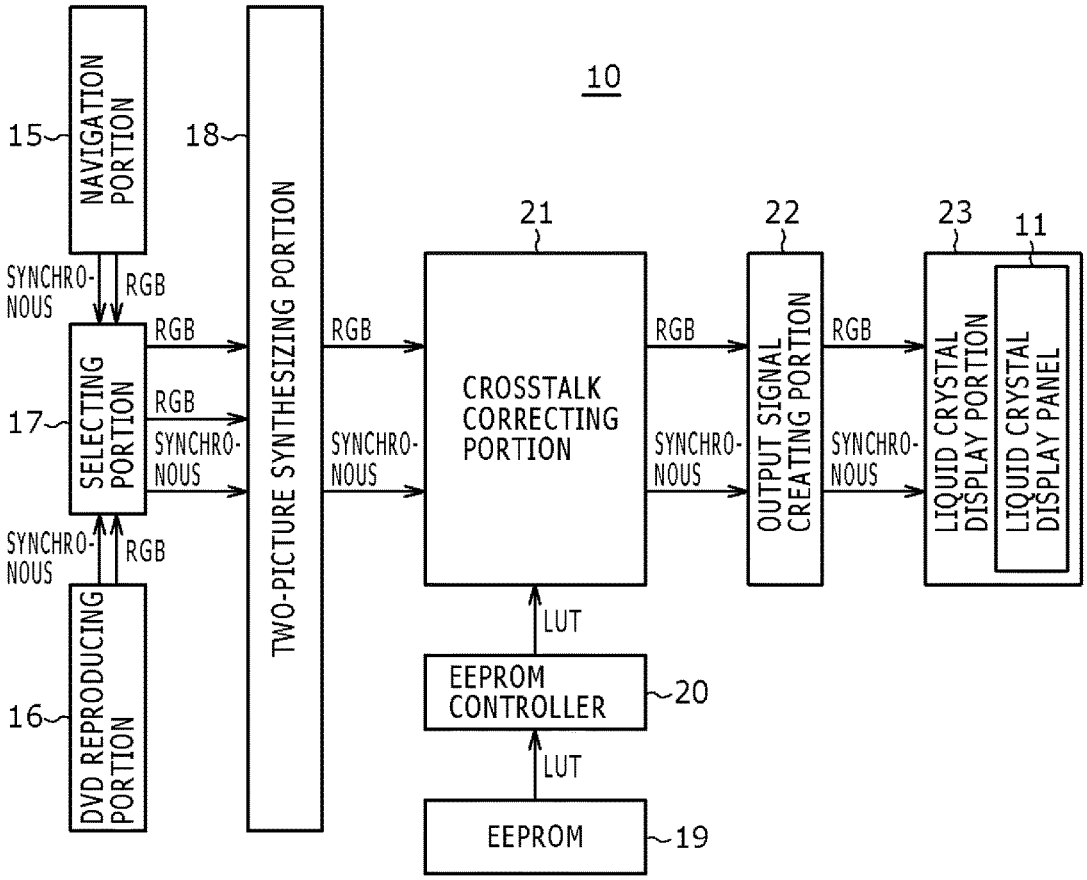
FIG. 5 is a block diagram showing an outline of a display device of the present application.

FIG. 5 is a block diagram showing the display device 10 including a crosstalk correcting portion for correcting both the electrical crosstalk and the optical crosstalk. The display device 10 includes a navigation portion 15, a DVD reproducing portion 16, a selecting portion 17, a two-picture synthesizing portion 18, an EEPROM 19, an EEPROM controller 20, a crosstalk correcting portion 21, an output signal creating portion 22, and a liquid crystal display portion 23. The navigation portion 15 outputs a navigation image before being synthesized, and the DVD reproducing portion 16 outputs a DVD-reproduced image before being synthesized. The selecting portion 17 selects either the navigation image outputted from the navigation portion 15 or the DVD-reproduced image outputted from the DVD reproducing portion 16 as the first image before being synthesized as shown in FIG. 2. Also, the selecting portion 17 selects either the navigation image outputted from the navigation portion 15 or the DVD-reproduced image outputted from the DVD reproducing portion 16 as the second image. For example, while the vehicle is stopped, the selecting portion selects the DVD-reproduced image as the second image as well as the first image, and while the vehicle is traveled, the selecting portion 17 selects the navigation image as the first image, and selects the DVD-reproduced image as the second image.

The two-picture synthesizing portion 18 sorts out the first image and the second image both selected by the selecting portion 17 in the checkered pattern as shown in FIG. 2, thereby synthesizing both the first image and the second image. Electrical correction tables of R, G and B, and optical correction tables of R, G and B are stored in the EEPROM 19. Electrical correction data on the gradations of all the adjacent sub-pixels for all the gradations of the sub-pixels each as an object of correction is stored in the electrical correction tables. Also, optical correction data on all the gradations of the sub-pixels, having the same color, in the adjacent pixels for all the gradations of the sub-pixels each as an object of the correction is stored in the optical correction tables. The correction data is values obtained from the experiments. The EEPROM controller 20 controls an operation for inputting/outputting the correction data to/from the EEPROM 19. The crosstalk correcting portion 21 carries out the crosstalk corrections by using the various kinds of LUTs. The output signal creating portion 22 controls a polarity and a timing for the signals which have been corrected in the crosstalk correcting portion 21 so that the signals which have been corrected in the crosstalk correcting portion 21 can be displayed in the form of the image corresponding thereto on the liquid crystal display portion 23. The liquid crystal display portion 23 includes a liquid crystal display panel 11, and a backlight, a gate driver, and a source driver (each not shown), and the like. In this case, the liquid crystal display panel 11 includes a light blocking barrier, displays thereon the synthetic image, and allows the first image and the second image to be discriminated from each other in the different visual directions, respectively. Also, the liquid crystal display portion 23 displays the data of R, G and B from the output signal creating portion 22 in the form of an image corresponding thereto in the internal liquid crystal display panel 11.

Figure 7A:
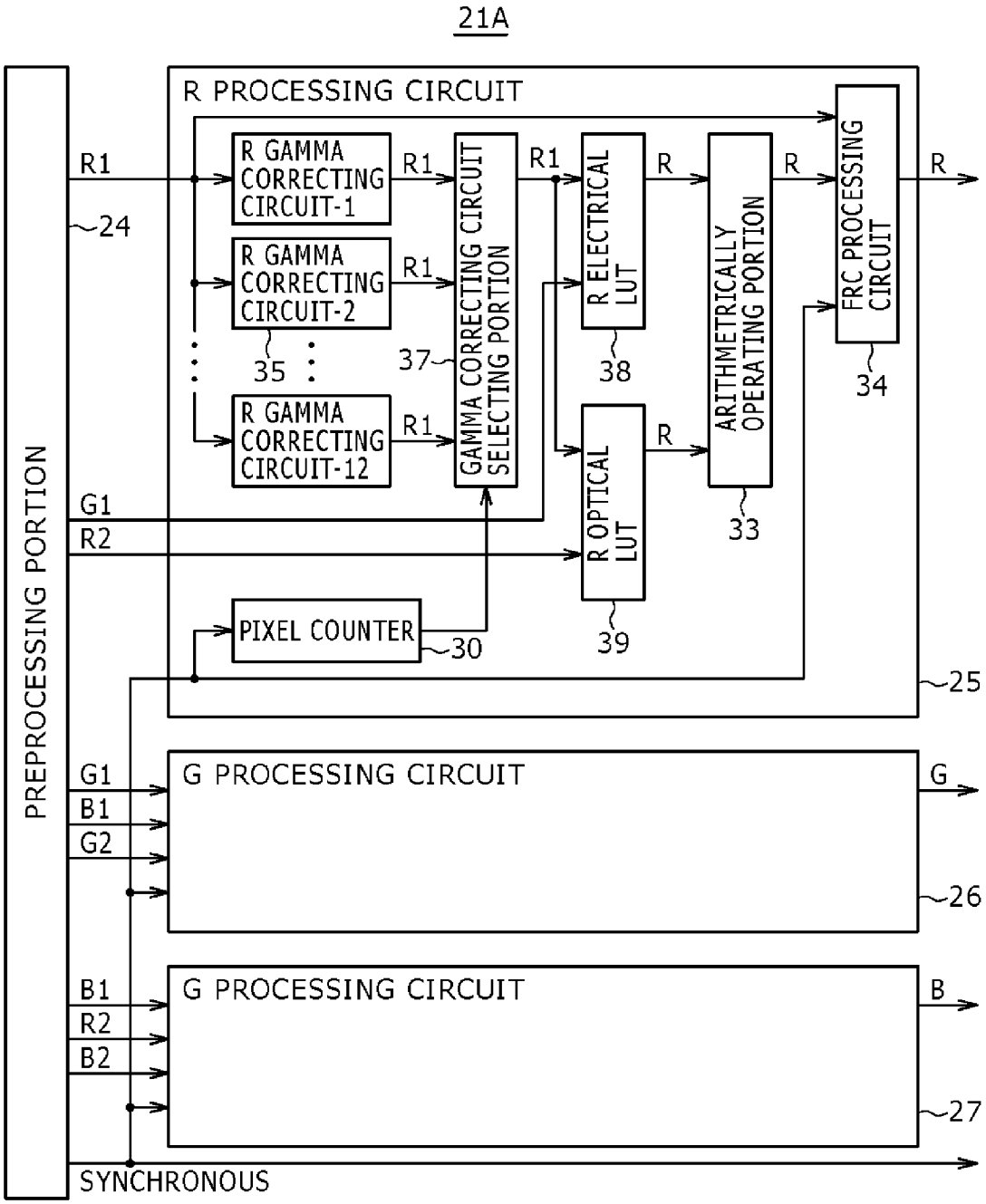
FIGS. 7A and 7B are respectively a block diagram showing an outline of a crosstalk correcting portion in a display device according to a first embodiment, and a block diagram showing an outline of a crosstalk correcting portion in a display device according to a second embodiment.

FIG. 7A is a detailed block diagram of the crosstalk correcting portion 21A. The crosstalk correcting portion 21A includes a preprocessing portion 24, an R processing circuit 25, a G processing circuit 26, and a B processing circuit 27. The preprocessing portion 24 sends necessary data among the synthetic image which is sent from the two-picture synthesizing portion 18 to the R processing circuit 25, the G processing circuit 26, and the B processing circuit 27 synchronously with a synchronous signal. The R processing circuit 25, the G processing circuit 26, and the B processing circuit 27 carry out the crosstalk corrections for the data of R, G and B, respectively.

Figure 6:
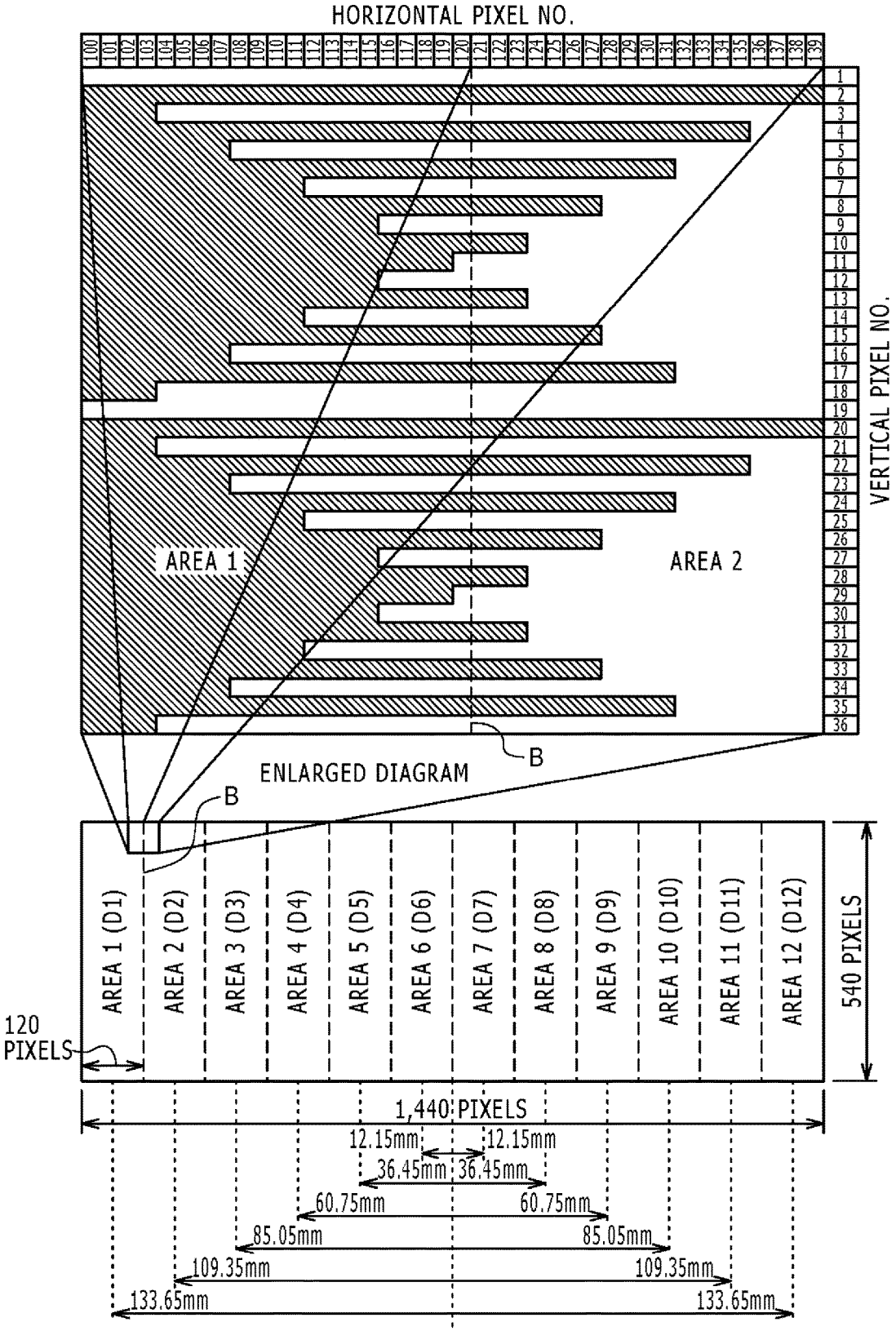
FIG. 6 is a top plan view showing division of a display area.
Figure 11A:
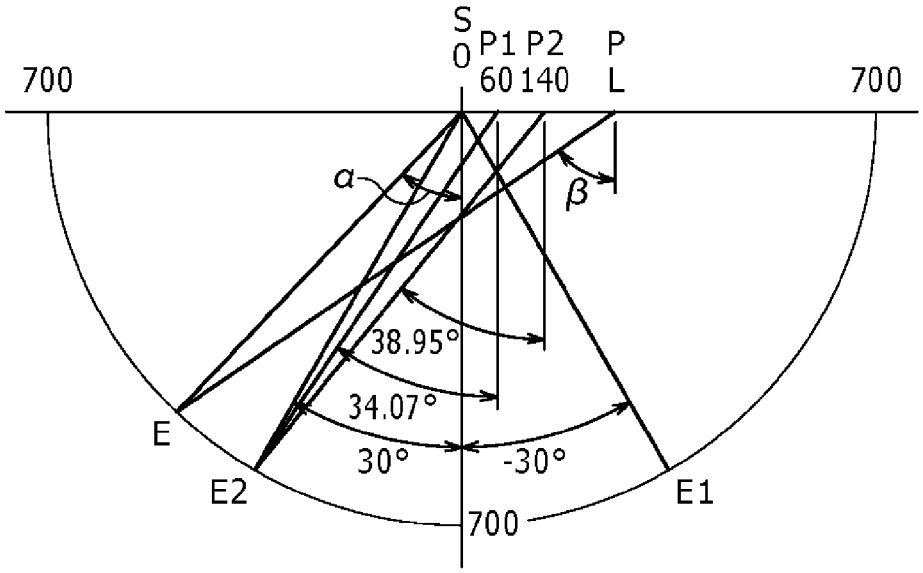
FIGS. 11A and 11B are respectively a diagram showing visual angle deviation of a position shifted from a center on a display area, and a graph explaining the visual angle deviation shown in FIG. 11A.
Figure 11B:
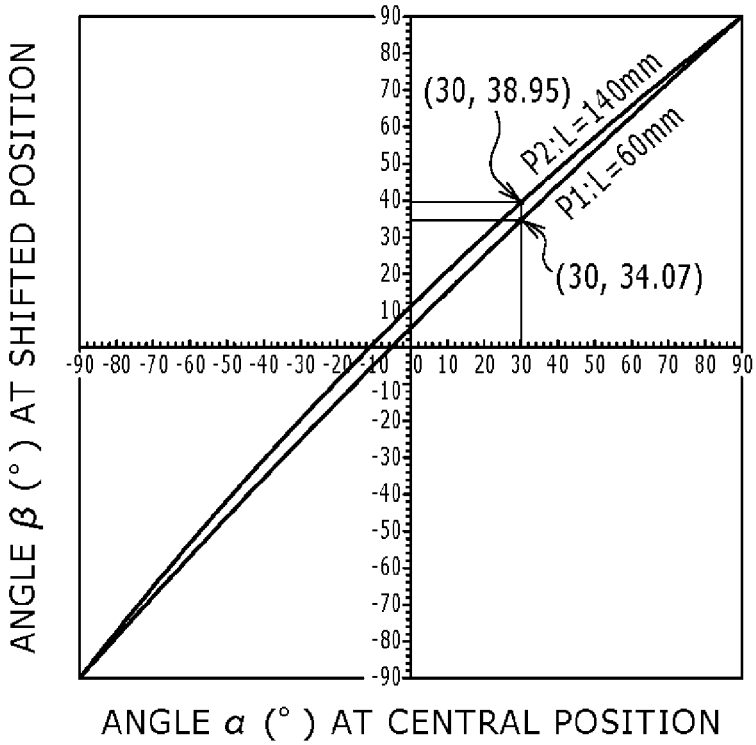

Firstly, a description will be given with respect to division for the display area 12, and the LUT for carrying out the crosstalk correction. As shown in FIGS. 11A and 11B, the visual angle differs depending on the positions on the display area 12. Therefore, not only the crosstalk due to the adjacent sub-pixels, but also the crosstalk due to the sub-pixels, having the same color, in the adjacent pixels differ in amount of crosstalk thereof depending on the positions on the display area. For this reason, in the first embodiment, as shown in FIG. 6, the display area 12 is divided into 12 parts, i.e., division areas D1 to D12, and gamma corrections corresponding to the division areas D1 to D12, respectively, are carried out. The division is carried out in units of pixels, and a delimiter of 120 pixels which are obtained by dividing 1,440 pixels in the transverse direction as the extension direction of each of the scanning lines into 12 parts is set as a reference line B for the division. If the division is carried out with the reference line B, it is feared that a difference between the luminances due to the difference between the gamma corrections for the right-hand and left-hand sides of the reference line B appears in the form of a straight line. In order to cope with this situation, in the first embodiment, the boundary lines are made not to be clearly understandable in such a way that each of the boundary lines among the division areas D1 to D12 does not become a straight line, that is, each of the shapes of the division areas D1 to D12 does not become rectangular. Specifically, as shown in FIG. 6, each of the boundary lines is made zigzag with the reference line B approximately as a center. Although an enlarged diagram is shown only between the division areas D1 and D2 in FIG. 6, the boundary lines among other division areas D2 to D12 are each similarly zigzag. It is noted that a position of the zigzag is gradually changed by an FRC which will be described later, thereby making it also possible to further have difficulty seeing.

Gradation data on the sub-pixel in the first embodiment is 6 bits of a normal black mode, and each of the luminances of R, G and B becomes 64 kinds from 0-th gradation to 63-th gradation. In addition, the display device 10 of the first embodiment has the normal black mode, and thus the 0-th gradation corresponds to black, and the 63-th gradation corresponds to white. Then, the electrical LUT as the correction table for the electrical crosstalk is a table of correction values which are obtained based on the 0-th to 63-th gradations of the sub-pixels each as an object of the correction, and the 0-th to 63-th gradations of the adjacent sub-pixels on the right-hand side of those sub-pixels. The optical LUT as the correction table for the optical crosstalk is a table of correction values which are obtained based on the 0-th to 63-th gradations of the sub-pixels each as an object of the correction, and the 0-th to 63-th gradations of the sub-pixels, having the same color, in the adjacent pixels on the right-hand side thereof.

Figure 8A:
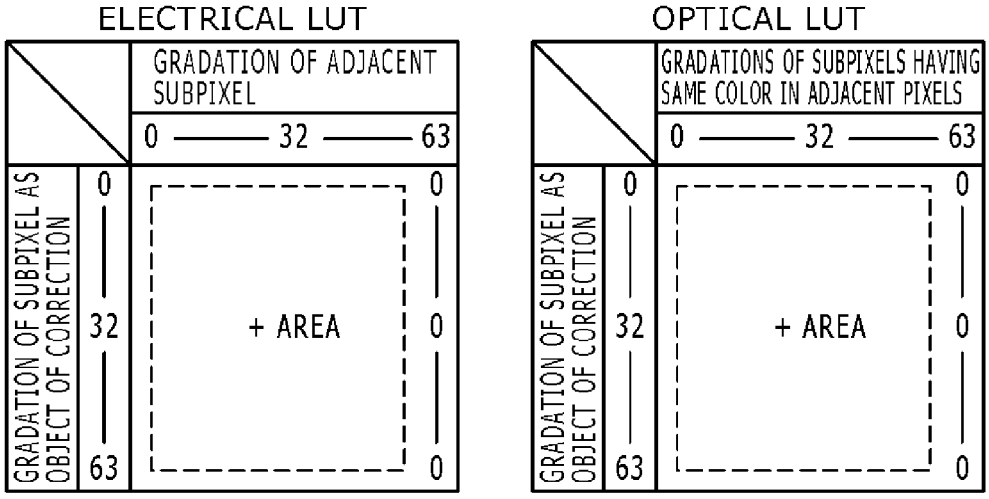
FIGS. 8A to 8C are respectively a diagram showing an LUT having an auto-reference, a diagram showing an LUT having a white reference, and a diagram showing an LUT having a black reference.
Figure 8B:
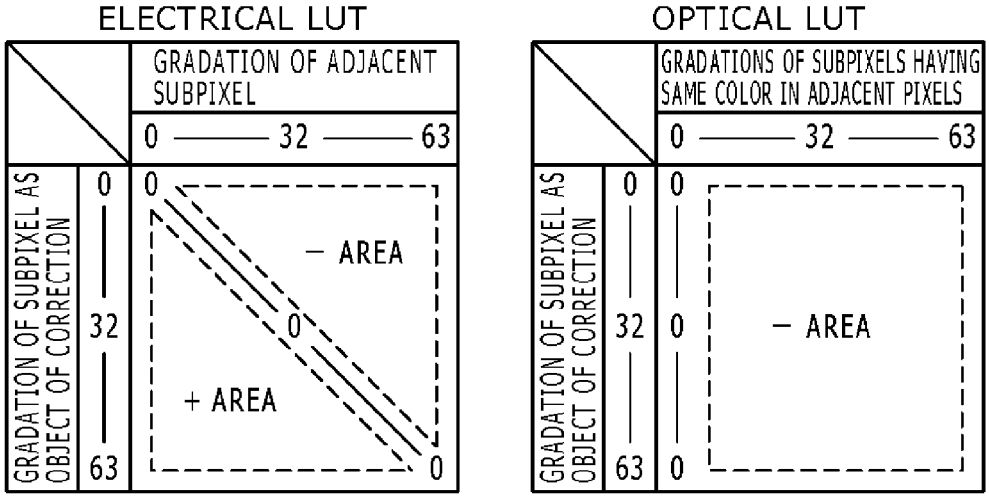
Figure 8C:
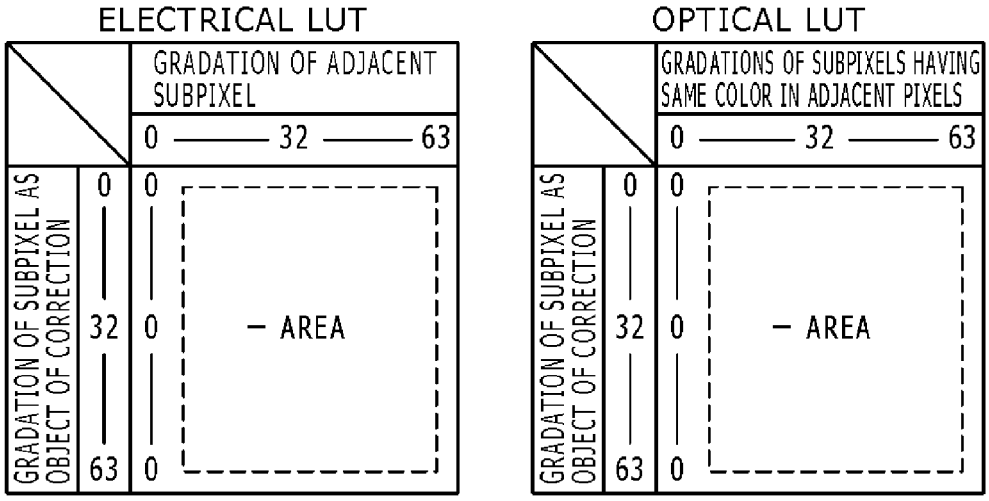

A plurality kind of electrical LUTs and optical LUTs are provided depending on the position where the reference of the gradation with which the correction data is made zero is set. For example, FIG. 8A shows the electrical LUT and the optical LUT each having a white reference. In this case, in the electrical LUT, the correction data is made zero when each of the gradations of the adjacent sub-pixels is the 63-th gradation corresponding to white, and in the optical LUT, the correction data is made zero when each of the gradations of the sub-pixels, having the same color, in the adjacent pixels on the right-hand side is the 63-th gradation corresponding to white. FIG. 8B shows the electrical LUT and the optical LUT each having an auto-reference in which a state not influenced from any of other sub-pixels is made another reference. In this case, in the electrical LUT, the correction value is made zero when both the gradations are equal to each other, and in the optical LUT, the correction data is made zero when each of the gradations of the sub-pixels, having the same color, in the adjacent pixels is the 0-th gradation corresponding to black free from the light leakage. FIG. 8C shows the electrical LUT and the optical LUT each having the black reference. In this case, in the electrical LUT, the correction value is made zero when each of the gradations of the adjacent sub-pixels is the 0-th gradation corresponding to black, and in the optical LUT, the correction data is made zero when each of the gradations of the sub-pixels, having the same color, in the adjacent pixels on the right-hand side is the 0-th gradation corresponding to black. The LUT having the white reference has such an advantage that the gradation in a low-luminance portion in which the difference between each adjacent two gradations is noticeable can be widely corrected as compared with the case of the LUT having the auto-reference. The LUT having the auto-reference has such an advantage that the contract is high.

Figure 10:
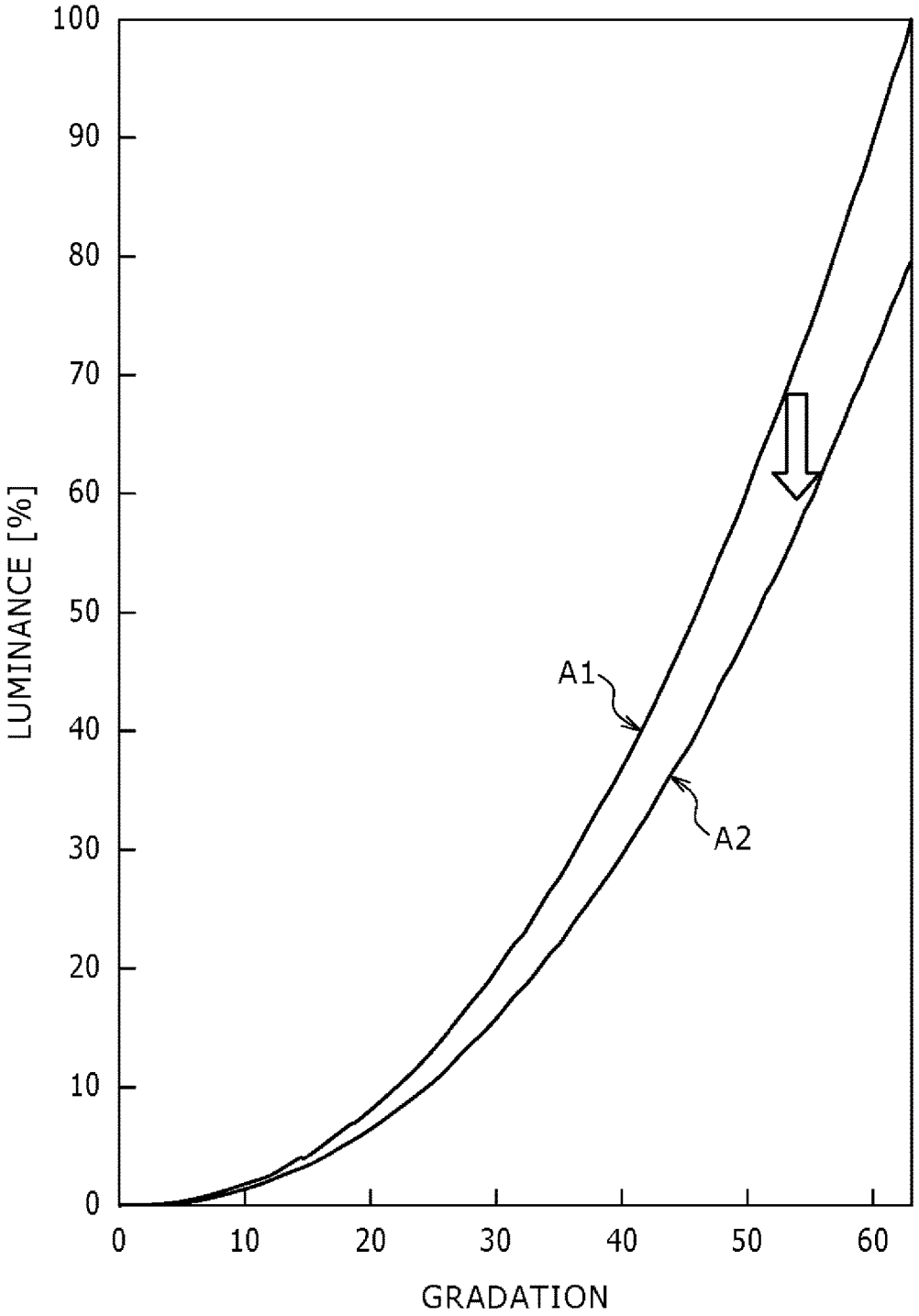
FIG. 10 is a graph showing a gamma correction.

Referring now to FIG. 7A, an R processing circuit 25 includes R gamma correcting circuits-1 to 12 each designated by reference numeral 35, a pixel counter 30, a gamma correcting circuit selecting portion 37, an R electrical LUT 38, an R optical LUT 39, an arithmetically operating portion 33, and an FRC processing circuit 34. In this case, the R gamma correcting circuits-1 to 12 (35) carries out the gamma corrections corresponding to the division areas D1 to D12, respectively. Also, the R gamma correcting circuits-1 to 12 (35) gamma-corrects the R data, of the sub-pixel as an object of the correction, sent from the preprocessing portion 24. The gamma correction values of the R gamma correcting circuits-1 to 12 (35) corresponding to the division areas D1 to D12 are obtained from the experiments on the division areas D1 to D12, respectively. For example, when the crosstalk obtained by combining the electrical crosstalk and the optical crosstalk in the division area D12 with each other is larger than that at the center of the display area 12, as shown in FIG. 10, the gamma correction is carried out in such a way that a gamma curve (gradation vs. luminance) is moved from a point A having gamma of 2.2 to a point B at which the luminance is reduced. The inventor found out that a method of taking measures to cope with the problem that the crosstalk differs depending on the difference in visual angle can be made collectively with the gamma corrections corresponding to the division areas D1 to D12, respectively, even when both the electrical crosstalk corrections and the optical crosstalk corrections corresponding to the division areas D1 to D12, respectively, are not carried out from the experiments and the studies. As a result, a simple configuration is obtained.

The gamma correcting circuit selecting portion 37 extracts any one, of the gamma correcting circuits-1 to 12 (35), corresponding to the division areas D1 to D12, respectively, to which the sub-pixel as an object of the correction from the 12 gamma correcting circuits-1 to 12 (35) in accordance with an operation of the pixel center 30. The R electrical LUT 38 receives as it inputs the data on the gradations of the sub-pixels each as an object of the correction from the gamma correcting circuit selecting portion 37, and the data on the gradations of the right-hand side sub-pixels from the preprocessing portion 24, and extracts the electrical correction data from the correction table in which the electrical correction data has been transferred from the EEPROM 19 to be stored. The R optical LUT 39 receives as its inputs the data on the gradations of the sub-pixels each as an object of the correction from the gamma correcting circuit selecting portion 37, and the data on the gradations of the sub-pixels, having the same color, in the right-hand side pixels from the preprocessing portion 24, and extracts the optical correction data from the correction table in which the optical correction data has been transferred from the EEPROM 19 to be stored. The arithmetically operating portion 33 adds the correction data from the electrical LUT 38, and the correction data from the optical LUT 39 to each other.

A Frame Rate Control (FRC) processing circuit 34 adds the correction data summed up in the arithmetically operating portion 33 to the data on the gradations of the sub-pixels each as an object of the correction from the preprocessing portion 24. Also, the FRC processing circuit 34 carries out the FRC with four frames as one cycle for the data of R inputted thereto from the arithmetically operating portion 33 and outputs the resulting data of R to the output signal creating portion 22. FIG. 9A is a diagram showing an example of disposition of the sub-pixels of the FRC. Also, FIG. 9B shows correction values for the sub-pixels of the FRC shown in FIG. 9A. The driving control for the luminances of the liquid crystal display panel 11 is carried out in units of one gradation. That is to say, it may be impossible to specify any of the gradations each not an integral number. However, a cycle of one picture (1,440 pixels×540 pixels), that is, a frame cycle is as large as 60 Hz. Thus, as shown in FIG. 9B, by utilizing the residual image, four frames are set as one cycle, and the frames in each of which the increase is made by one gradation during one cycle are set as one frame, and thus 0.25 gradations are seemingly as one unit. The FRC is carried out in such a manner. For example, when during the time period of the 1.75 gradations, of four frames of one cycle, one frame is set as one gradation, and the remaining three frames are set as two gradations, the gradations appear as 1.75 gradations by the residual gradation. In addition, for the purpose of reducing a flicker as shown in FIG. 9A, the positions of the sub-pixels in each of which the increase is made by one gradation are scattered by changing the position of the frame. Each of the G processing circuit 26 and the B processing circuit 27 has the same configuration as that of the R processing circuit 25, and the G processing circuit 26 and the B processing circuit 27 carry out the crosstalk corrections for the G data and the B data from the preprocessing circuit 24 by using the LUTs corresponding to the division areas, respectively, and output the resulting G data and B data to the output signal creating portion 22. In such a manner, since the FRC processing is executed, there are also offered such effects that not only the delicate display can be carried out, but also any of the boundary lines among the division areas D1 to D12 come to have difficulty seeing.

Next, a description will be given below with respect to image processing in the display device 10 having the configuration described above with reference to FIG. 5. When a power source switch (not shown) of the display device 10 is turned ON, the EEPROM controller 20 transfers the electrical correction tables and the optical correction tables of R, G and B in the EEPROM 19 to the crosstalk correcting portion 21. As shown in FIG. 5, the selecting portion 17 selects either the navigation image outputted from the navigation portion 15 or the DVD-reproduced image outputted from the DVD reproducing portion 16 as the first image. Also, the selecting portion 17 selects either the navigation image outputted from the navigation portion 15 or the DVD-reproduced image outputted from the DVD reproducing portion 16 as the second image. The two-picture synthesizing portion 18 sorts out the first image (1,440 pixels×540 pixels) and the second image (1,440 pixels×540 pixels) which are inputted thereto from the selecting portion 17 in a checkered pattern of the sub-pixels, thereby synthesizing the first image and the second image into one image (1,440 pixels×540 pixels).

The preprocessing portion 24 of the crosstalk correcting portion 21 sends the necessary data which is sent from the synthetic image inputted thereto from the two-picture synthesizing portion 18 to the R processing circuit 25, the G processing circuit 26, and the B processing circuit 27 synchronously with the synchronous signal. In the R processing circuit 25, the R gamma correcting circuits-1 to 12 (35) carry out the gamma correction for the R data of the sub-pixels each as an object of the correction from the preprocessing portion 24. The gamma correcting circuit selecting portion 37 extracts any one, of the 12 gamma correcting circuits-1 to 12 (35) corresponding to the division areas D1 to D12, respectively, to which the sub-pixels each as an object of the correction belong from the 12 gamma correcting circuits-1 to 12 (35). The R electrical LUT 38 receives as its inputs the data on the gradations of the sub-pixels each as an object of the correction from the gamma correcting circuit selecting portion 37, and the data on the gradations of the right-hand side sub-pixels from the preprocessing portion 24. Also, the R electrical LUT 38 extracts the electrical correction data from the correction table in which the electrical correction data has been transferred from the EEPROM 19 to be stored. The R optical LUT 39 receives as its inputs the data on the gradations of the sub-pixels each as an object of the correction from the gamma correcting circuit selecting portion 37, and the data on the gradations of the sub-pixels, having the same color, in the right-hand side pixels from the preprocessing portion 24. Also, the R optical LUT 39 extracts the optical correction data from the correction table in which the optical correction data has been transferred from the EEPROM 19 to be stored. The arithmetically operating portion 33 adds the correction data from the electrical LUT 38, and the correction data from the optical LUT 39 to each other. The FRC processing circuit 34 adds the correction data summed up in the arithmetically operating portion 33 to the data on the gradations of the sub-pixels each as an object of the correction from the preprocessing portion 24. Also, the FRC processing circuit 34 carries out the FRC with four frames as one cycle for the data of R inputted thereto from the arithmetically operating portion 33 and outputs the data of R to the output signal creating portion 22.

Each of the G processing circuit 26 and the B processing circuit 27 executes the same processing as that executed by the R processing circuit 25. Also, after the G processing circuit 26 and the B processing circuit 27 carry out the gamma corrections corresponding to the respective division areas for the G data and the B data from the preprocessing circuit 24, respectively, the G processing circuit 26 and the B processing circuit 27 carry out the crosstalk corrections for the resulting G data and B data, respectively, and output the resulting G data and B data to the output signal creating portion 22. The output signal creating portion 22 controls the polarity and the timing for the signals which have been corrected in the crosstalk correcting portion 21 so that the signals which have been corrected in the crosstalk correcting portion 21 can be displayed in the form of the image on the liquid crystal display portion 23. The liquid crystal display portion 23 displays the image corresponding to the data of R, G and B from the output signal creating portion 22 on the internal liquid crystal panel 11.

As has been described, according to the first embodiment, after the display area 12 is divided into the division areas D1 to D12, and the gamma corrections corresponding to the division areas D1 to D12, respectively, are carried out, the crosstalk corrections are carried out. As a result, it is possible to reduce the problem that the difference in visual angle is caused depending on the positions on the display area, so that the amount of crosstalk differs depending on the positions on the display area.

Second Embodiment

Although a second embodiment will be described hereinafter with reference to corresponding ones of the accompanying drawings by focusing on a difference from the first embodiment, the second embodiment which will be shown below are not intended to limit the present application to the description. Thus, the present application can be equally applied to various kinds of changes which are made without departing from the technical idea shown in the appended claims. It is noted that in the drawings used for the descriptions in this specification, for the purpose of making layers and members have such sizes that they can be recognized on the drawings, the scale size is shown so as to be made to differ every layer and member, and thus is not necessarily shown in proportion to the actual size.

The electrical correction tables of R, G and B, and the optical correction tables of R, G and B which correspond to the division areas D1 to D12 which will be described later, respectively, are stored in the EEPROM 19. The electrical correction data on the gradations of all the adjacent sub-pixels for all the gradations of the sub-pixels each as an object of correction is stored in the electrical correction table. Also, the optical correction data on all the gradations of the sub-pixels, having the same color, in the adjacent pixels for all the gradations of the sub-pixels each as an object of the correction is stored in the optical correction tables. The correction data is the values obtained from the experiments. The EEPROM controller 20 controls the operation for inputting/outputting the correction data to/from the EEPROM 19. The crosstalk correcting portion 21 carries out the crosstalk corrections by using the various kinds of LUTs stored in the EEPROM 19. The output signal creating portion 22 controls the polarity and the timing for the signals which have been corrected in the crosstalk correcting portion 21 so that the signals which have been corrected in the crosstalk correcting portion 21 can be displayed in the form of the image corresponding thereto on the liquid crystal display portion 23. The liquid crystal display portion 23 includes the liquid crystal display panel 11, and the backlight, the gate driver, and the source driver (each not shown), and the like. In this case, the liquid crystal display panel 11 includes the light blocking barrier, displays thereon the synthetic image, and allows the first image and the second image to be discriminated from each other in the different visual directions, respectively. Also, the liquid crystal display portion 23 displays the data of R, G and B from the output signal creating portion 22 in the form of the image corresponding thereto in the internal liquid crystal display panel 11.

Figure 7B:
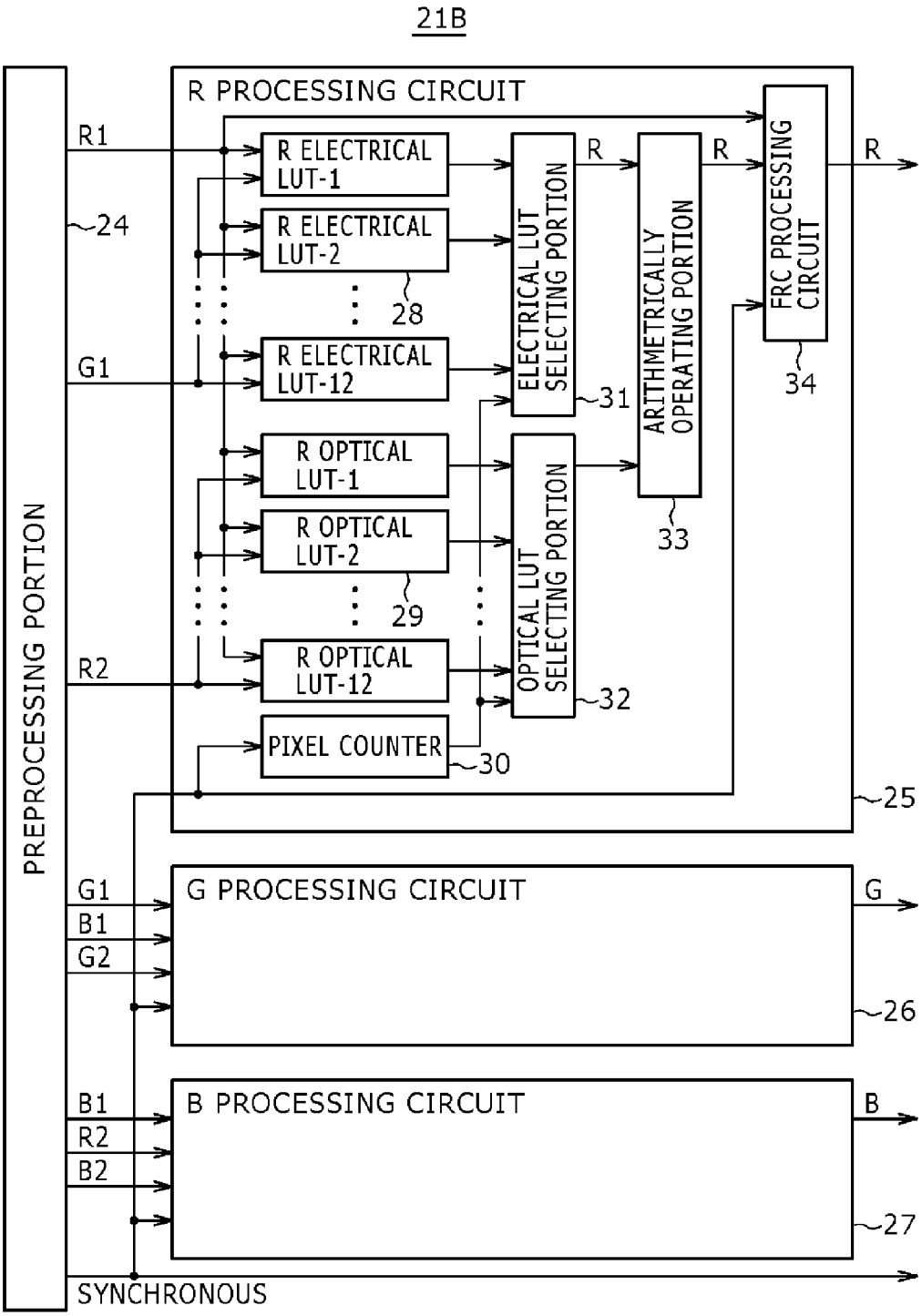

FIG. 7B is a detailed block diagram of the crosstalk correcting portion 21B. The crosstalk correcting portion 21B includes the preprocessing portion 24, the R processing circuit 25, the G processing circuit 26, and the B processing circuit 27. The preprocessing portion 24 sends the necessary data among the synthetic image which is from the two-picture synthesizing portion 18 to the R processing circuit 25, the G processing circuit 26, and the B processing circuit 27 synchronously with the synchronous signal. The R processing circuit 25, the G processing circuit 26, and the B processing circuit 27 carry out the crosstalk corrections for the data of R, G and B, respectively.

Firstly, a description will be given with respect to the LUT for carrying out the crosstalk correction. As shown in FIGS. 11A and 11B, the visual angle differs depending on the positions on the display area 12. Therefore, not only the crosstalk due to the adjacent sub-pixels, but also the crosstalk due to the sub-pixels, having the same color, in the adjacent pixels differ in amount of crosstalk thereof depending on the positions on the display area. For this reason, in the second embodiment, as shown in FIG. 6, the display area 12 is divided into the 12 parts, i.e., the division areas D1 to D12, and the LUTs corresponding to the division areas D1 to D12, respectively, are provided as shown in FIG. 6. The division is carried out in units of pixels, and the delimiter of the 120 pixels which are obtained by dividing the 1,440 pixels in the transverse direction as the extension direction of the scanning lines into the 12 parts is set as the reference line B for the division. If the division is carried out with the reference line B, it is feared that the difference between the luminances due to the difference between the LUTs on the right-hand and left-hand sides of the reference line B appears in the form of the straight line. In order to cope with this situation, in the second embodiment, the boundary lines are made not to be clearly understandable in such a way that each of the boundary lines among the division areas D1 to D12 does not become a straight line, that is, each of the shapes of the division areas D1 to D12 does not become rectangular. Specifically, as shown in FIG. 6, each of the boundary lines is made zigzag with the reference line B approximately as a center. Although an enlarged diagram is shown only between the division areas D1 and D2 in FIG. 6, the boundary lines among other division areas D2 to D12 are each similarly zigzag. It is noted that a position of the zigzag is gradually changed by the FRC which will be described later, thereby making it also possible to further have difficulty seeing.

The gradation data on the sub-pixel in the second embodiment is 6 bits of the normal black mode, and each of the luminances of R, G and B becomes 64 kinds from the 0-th gradation to the 63-th gradation. In addition, the display device 10 of the second embodiment has the normal black mode, and thus the 0-th gradation corresponds to black, and the 63-th gradation corresponds to white. Then, the electrical LUT as the correction table for the electrical crosstalk is the table of the correction values which are obtained based on the 0-th to 63-th gradations of the sub-pixels each as an object of the correction, and the 0-th to 63-th gradations of the adjacent sub-pixels on the right-hand side of those sub-pixels. The optical LUT as the correction table for the optical crosstalk is the table of the correction values which are obtained based on the 0-th to 63-th gradations of the sub-pixels each as an object of the correction, and the 0-th to 63-th gradations of the sub-pixels, having the same color, in the adjacent pixels on the right-hand side thereof.

A plurality kind of electrical LUTs and optical LUTs are provided depending on the position where the reference of the gradation with which the correction data is made zero is set. For example, FIG. 8A shows the electrical LUT and the optical LUT each having the white reference. In this case, in the electrical LUT, the correction data is made zero when each of the gradations of the adjacent sub-pixels is the 63-th gradation corresponding to white, and in the optical LUT, the correction data is made zero when each of the gradations of the sub-pixels, having the same color, in the adjacent pixels on the right-hand side is the 63-th gradation corresponding to white. FIG. 8B shows the electrical LUT and the optical LUT each having the auto-reference in which the state not influenced from any of other sub-pixels is made another reference. In this case, in the electrical LUT, the correction value is made zero when both the gradations are equal to each other, and in the optical LUT, the correction data is made zero when each of the gradations of the sub-pixels, having the same color, in the adjacent pixels is the 0-th gradation corresponding to black free from the light leakage. FIG. 8C shows the electrical LUT and the optical LUT each having the black reference. In this case, in the electrical LUT, the correction value is made zero when each of the gradations of the adjacent sub-pixels is the 0-th gradation corresponding to black, and in the optical LUT, the correction data is made zero when each of the gradations of the sub-pixels, having the same color, in the adjacent pixels on the right-hand side is the 0-th gradation corresponding to black. The LUT having the white reference has the advantage such that the gradation in the low-luminance portion in which the difference between each adjacent two gradations is noticeable can be widely corrected as compared with the case of the LUT having the auto-reference. The LUT having the auto-reference has the advantage that the contract is high.

The R processing circuit 25 includes the R electrical LUTs-1 to 12 each designated by reference numeral 28, the R optical LUTs-1 to 12 each designated by reference numeral 29, the pixel counter 30, the electrical LUT selecting portion 31, the optical LUT selecting portion 32, the arithmetically operating portion 33, and the FRC processing circuit 34. In this case, the R optical LUTs-1 to 12 (28) store therein the electrical correction tables for the R data corresponding to the division areas D1 to D12, respectively. Also, the R optical LUTs-1 to 12 (29) store therein the optical correction tables for the R data corresponding to the division areas D1 to D12, respectively. The R electrical LUTs-1 to 12 (28) receive as their inputs the data on the gradations of the sub-pixels each as an object of the correction, and the data on the sub-pixels on the right-hand side thereof which are sent from the preprocessing portion 24. Also, the R electrical LUTs-1 to 12 (28) extract the electrical correction data from the correction tables in which the electrical correction data has been transferred from the EEPROM 19 to be stored. The R optical LUTs-1 to 12 (29) receive as their inputs the data on the gradations of the sub-pixels each as an object of the correction, and the data on the gradations of the sub-pixels, having the same color, in the pixels on the right-hand side thereof both of which are sent from the preprocessing portion 24. Also, the R optical LUTs-1 to 12 (29) extract the optical correction data from the correction tables in which the optical correction data has been transferred from the EEPROM 19 to be stored. The connection tables of the R electrical LUTs-1 to 12 (28), and the R optical LUTs-1 to 12 (29) are respectively tables in which the correction data at the central portions of the division areas D1 to D12 corresponding thereto, respectively, is obtained from the experiments. For example, when an amount of optical crosstalk becomes large from the division area D7 approximately at the center toward the division area D12 at the edge portion, in any of the white reference, the auto-reference, and the black reference, an amount of correction in the correction table (an absolute value of the correction data) is gradually increased from the R optical LUT-7 toward the R optical LUT-12. For example, in the case where each of the gradations of the sub-pixels each as an object of the correction is taken to be i (i=0 to 63) and each of the gradations of the sub-pixels, having the same color, in the adjacent pixels is taken to be j (j=0 to 63), when the correction data in the optical crosstalk correction table for the n-th (n=1 to 12) division area Dn is taken to be Dn(i, j), a relationship of $|D7(i, j)| \leq |D8((i, j)| \leq |D9(i, j)| \leq |D10(i, j)| \leq |D11(i, j)| \leq |D12(i, j)|$ is established.

The electrical LUT selecting portion 31 extracts any one, of the 12 R electrical LUTs-1 to 12 (28) corresponding to the division areas D1 to D12, respectively, to which the sub-pixels each as an object of the correction belong from the 12 R electrical LUTs-1 to 12 (28) in accordance with the operation of the pixel counter 30. The optical LUT selecting portion 32 extracts any one, of the 12 R optical LUTs-1 to 12 (29) corresponding to the division areas D1 to D12, respectively, to which the sub-pixels each as an object of the correction belong from the 12 R optical LUTs-1 to 12 (29) in accordance with the operation of the pixel counter 30. The arithmetically operating portion 33 adds the correction data from the electrical LUT selecting portion 31, and the correction data from the optical LUT selecting portion 32 to each other.

The FRC processing circuit 34 adds the correction data summed up in the arithmetically operating portion 33 to the data on the gradations of the sub-pixels each as an object of the correction from the preprocessing portion 24. Also, the FRC processing circuit 34 carries out the FRC with four frames as one cycle for the data of R inputted thereto from the arithmetically operating portion 33 and outputs the resulting data of R to the output signal creating portion 22. FIG. 9A is the diagram showing the example of disposition of the sub-pixels of the FRC. Also, FIG. 9B shows the correction values for the sub-pixels of the FRC shown in FIG. 9A. The driving control for the luminances of the liquid crystal display panel 11 is carried out in units of one gradation. That is to say, it may be impossible to specify any of the gradations each not an integral number. However, the cycle of one picture (1,440 pixels×540 pixels), that is, the frame cycle is as larger as 60 Hz. Thus, as shown in FIG. 9B, by utilizing the residual image, four frames are set as one cycle, and the frames in each of which the increase is made by one gradation during one cycle are set as one frame, and thus the 0.25 gradations is seemingly as one unit. The FRC is carried out in such a manner. For example, when during the time period of the 1.75 gradations, of four frames of one cycle, one frame is set as one gradation, and the remaining three frames are set as two gradations, the gradations appear as the 1.75 gradations by the residual gradation. In addition, for the purpose of reducing the flicker, as shown in FIG. 9A, the positions of the sub-pixels in each of which the increase is made by 1 gradation are scattered by changing the position of the frame. Each of the G processing circuit 26 and the B processing circuit 27 has the same configuration as that of the R processing circuit 25, and the G processing circuit 26 and the B processing circuit 27 carry out the crosstalk corrections for the G data and the B data from the preprocessing circuit 24 by using the LUTs corresponding to the division areas, respectively, and output the resulting G data and B data to the output signal creating portion 22. In such a manner, since the FRC processing is executed, there are also offered the effects such that not only the delicate display can be carried out, but also any of the boundary lines among the division areas D1 to D12 come to have difficulty seeing.

Next, a description will be given below with respect to the image processing in the display device 10 having the configuration described above with reference to FIG. 5. When the power source switch (not shown) of the display device 10 is turned ON, the EEPROM controller 20 transfers the electrical correction tables and the optical correction tables of R, G and B in the EEPROM 19 corresponding to the respective division areas to the crosstalk correcting portion 21. As shown in FIG. 5, the selecting portion 17 selects either the navigation image outputted from the navigation portion 15 or the DVD-reproduced image outputted from the DVD reproducing portion 16 as the first image. Also, the selecting portion 17 selects either the navigation image outputted from the navigation portion 15 or the DVD-reproduced image outputted from the DVD reproducing portion 16 as the second image. The two-picture synthesizing portion 18 sorts out the first image (1,440 pixels×540 pixels) and the second image (1,440 pixels×540 pixels) which are inputted thereto from the selecting portion 17 in the checkered pattern of the sub-pixels, thereby synthesizing the first image and the second image into one image (1,440 pixels×540 pixels).

The preprocessing portion 24 of the crosstalk correcting portion 21 sends the necessary data which is sent from the synthetic image inputted thereto from the two-picture synthesizing portion 18 to the R processing circuit 25, the G processing circuit 26, and the B processing circuit 27 synchronously with the synchronous signal. In the R processing circuit 25, the R electrical LUTs-1 to 12 (28) receive their inputs the data on the gradations of the sub-pixels each as an object of the correction, and the data on the gradations of the sub-pixels on the right-hand side thereof from the preprocessing portion 24. Also, the R electrical LUTs-1 to 12 (28) extract the electrical correction data from the respective correction tables in which the electrical correction data has been transferred from the EEPROM 19 to be stored. In addition, the R optical LUTs-1 to 12 (29) receive as their inputs the data on the gradations of the sub-pixels each as an object of the correction, and the data on the gradations of the sub-pixels, having the same color, on the right-hand side thereof from the preprocessing portion 24. Also, the R optical LUTs-1 to 12 (29) extract the optical correction data from the respective correction tables in which the optical correction data has been transferred from the EEPROM 19 to be stored. The electrical LUT selecting portion 31 extracts any one, of the 12 R electrical LUTs-1 to 12 (28) corresponding to the division areas D1 to D12, respectively, to which the sub-pixels each as an object of the correction belong from the 12 R electrical LUTs-1 to 12 (28) in accordance with the operation of the pixel counter 30. The optical LUT selecting portion 32 extracts any one, of the 12 R optical LUTs-1 to 12 (29) corresponding to the division areas D1 to D12, respectively, to which the sub-pixels each as an object of the correction belong from the 12 R optical LUTs-1 to 12 (29) in accordance with the operation of the pixel counter 30. The arithmetically operating portion 33 adds the correction data from the electrical LUT selecting portion 31, and the correction data from the optical LUT selecting portion 32 to each other. The FRC processing portion 34 adds the correction data summed up in the arithmetically operating portion 33 to the data on the gradations of the sub-pixels each as an object of the correction from the preprocessing portion 24. Also, the FRC processing portion 34 carries out the FRC, with four frames as one cycle, for the R data inputted from the arithmetically operating portion 33, and outputs the resulting R data to the output signal creating portion 22 in accordance with the operation of the pixel counter 30.

Each of the G processing circuit 26 and the B processing circuit 27 executes the same processing as that executed in the R processing circuit 25. Also, the G processing circuit 26 and the B processing circuit 27 carry out the crosstalk correction for the G data and the B data which have been sent from the preprocessing circuit 24 by using the LUTs corresponding to the respective division areas, and output the resulting G data and B data to the output signal creating portion 22. The output signal creating portion 22 controls the polarity and the timing for the signals which have been corrected in the crosstalk correcting portion 21 so that the signals which have been corrected in the crosstalk correcting portion 21 can be displayed in the form of the image on the liquid crystal display portion 23. The liquid crystal display portion 23 displays the image corresponding to the data of R, G and B from the output signal creating portion 22 on the internal liquid crystal panel 11.

As has been described, according to the second embodiment, after the display area 12 is divided into the division areas D1 to D12, and the crosstalk corrections corresponding to the positions on the display areas, respectively, are carried out by using the crosstalk correction tables corresponding to the division areas D1 to D12, respectively. As a result, it is possible to reduce the problem such that the difference in visual angle is caused depending on the positions on the display area, so that the amount of crosstalk differs depending on the positions on the display area.

In each of the first and second embodiments of the present application, the display area is divided in the extension direction (in the transverse direction) of each of the scanning lines, thereby coping with the difference in amount of crosstalk in the extension direction (in the transverse direction) of each of the scanning lines. However, since the difference in visual angle is caused in the extension direction (in the longitudinal direction) as well of each of the signal lines, and thus an amount of crosstalk differs, the display area may be divided into division areas in the extension direction as well of each of the signal lines, and crosstalk correction tables corresponding to the division areas, respectively, may be used. In addition, the technique of each of the first and second embodiments for displaying the different images in the different visual directions, respectively, so as to allow the different images to be discriminated from each other is based on the slits having the checkered pattern of the light blocking barrier. However, the present application can also be applied to the display device using any other suitable method based on a light blocking pattern of a liquid crystal shutter, a lenticular lens or the like. In addition, although the display panel of each of the first and second embodiments is the liquid crystal display panel, the present application can also be applied to any other suitable display panel such as an organic EL. In addition, the present application can also be applied to the display device for monochrome display or monochrome color in which one pixel is composed of one sub-pixel.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A display device, comprising:

display panel having a display area having a plurality of pixels that are disposed in a matrix and each are composed of one or more sub-pixels, wherein the display area is divided into a plurality of division areas, at least one of the division areas is non-rectangular and includes a plurality of extending portions, a shape of a border of at least one of the division areas is zigzag.

2. The display device according to claim 1, wherein a gamma correction which differs so as to correspond to the division areas, respectively, is carried out for an image.

3. The display device according to claim 2, wherein a first image and a second image being alternately displayed adjacent to each other in the sub-pixels, the first image and the second image being displayed in visual directions different from each other so as to be adapted to be discriminated from each other.

4. The display device according to claim 2, wherein the gamma correction is carried out for the image as an object of a cross talk correction, the display device further comprising crosstalk correcting portion having a crosstalk correcting table, configured to carry out the crosstalk correction for images different from one another by using the crosstalk correcting table, and the crosstalk correcting table is composed of a plurality of crosstalk correcting tables corresponding to the plurality of the division areas, respectively.

5. The display device according to claim 4, wherein the crosstalk correcting portion carries out the crosstalk correction of K (K is an integral number) gradations for N1 (N1 is a positive integral number of smaller than N) in N (N is a positive integral number of equal to or larger than 2) frames, and carries out the crosstalk correction of the (K+1) gradations for the (N−N1) frames.

6. The display device according to claim 3, wherein the display panel includes slits of a light blocking layer with which the first image and the second image are made to be adapted to be discriminated from each other in different visual directions, respectively.

7. The display device according to claim 4, wherein the crosstalk correcting table contains correction data corresponding to gradations of object sub-pixels each as an object of the correction, and gradations of first adjacent sub-pixels that are adjacent to the object sub-pixels.

8. The display device according to claim 4, wherein the one pixel is composed of sub-pixels having colors different from one another, and the crosstalk correcting table contains therein data corresponding to gradations of the object sub-pixels each as an object of the correction, and gradations of second adjacent sub-pixels that are adjacent to the object sub-pixels and have the same color as the object sub-pixels.

9. The display device according to claim 7, wherein the crosstalk correcting table has a white reference, and correction data is zero when each of the gradations of the first adjacent sub-pixels is the 63-th gradation corresponding to white.

10. The display device according to claim 8, wherein the crosstalk correcting table has a white reference, and correction data is zero when each of the gradations of the second adjacent sub-pixels is the 63-th gradation corresponding to white.

11. The display device according to claim 7, wherein the crosstalk correcting table has an auto-reference that refers to a state independent on other sub-pixels than the object sub-pixels, and correction data is zero when the gradations of the object sub-pixels and the first adjacent subpixels are equal.

12. The display device according to claim 8, wherein the crosstalk correcting table has an auto-reference that refers to a state independent on other sub-pixels than the object sub-pixels, and correction data is zero when each of the gradations of the second adjacent sub-pixels is the 0-th gradation corresponding to black with no light leakage.

13. The display device according to claim 7, wherein the crosstalk correcting table has a black reference, and correction data is zero when each of the gradations of the first adjacent sub-pixels is the 0-th gradation corresponding to black.

14. The display device according to claim 8, wherein the crosstalk correcting table has a black reference, and the correction data is zero when each of the gradations of the second adjacent sub-pixels is the 0-th gradation corresponding to black.

* * * * *